United States Patent [19]

Pinson

[11] Patent Number: 4,770,370

[45] Date of Patent: Sep. 13, 1988

[54] OPTICAL FIBER GUIDED TUBE-LAUNCHED PROJECTILE SYSTEM

[75] Inventor: George T. Pinson, Huntsville, Ala.

[73] Assignee: The Boeing Company, Seattle, Wash.

[21] Appl. No.: 32,448

[22] Filed: Mar. 31, 1987

[51] Int. Cl.[4] ..... F41G 7/32

[52] U.S. Cl. ..... 244/3.12

[58] Field of Search ..... 244/3.12

[56] References Cited

U.S. PATENT DOCUMENTS

| | | | |
|---|---|---|---|
| 3,233,548 | 2/1966 | Chilowsky | 244/3.12 |
| 4,185,796 | 1/1980 | Riley | 244/3.12 |
| 4,573,647 | 3/1986 | Laten et al. | 244/3.12 |
| 4,611,771 | 9/1986 | Gibbons et al. | 244/3.12 |
| 4,615,496 | 10/1986 | Pinson | 244/3.16 |

*Primary Examiner*—Charles T. Jordan

*Attorney, Agent, or Firm*—Finnegan, Henderson, Farabow, Garrett & Dunner

[57] ABSTRACT

An optical fiber guided projectile for firing from a generally tubular launcher comprising a tubular casing, an extended length of optical fiber disposed in the casing for continuous streaming from the trailing end thereof, a portion of the fiber extending from the casing for operative connection to a controller, an axial groove in the casing surface for removably receiving a part of the extending fiber, tape securing the fiber part in the groove with force sufficient to withstand axial launch forces but insufficient to resist imposed radial forces, and a communication device providing two-way communication over the fiber. A controller is also provided in two-way communication with the projectile for receiving and processing target data from the projectile and for transmitting guidance data, including operator manual guidance, to the projectile.

18 Claims, 5 Drawing Sheets

OPTICAL FIBER GUIDED TUBE-LAUNCHED PROJECTILE SYSTEM

BACKGROUND OF THE INVENTION

1. Field of the Invention

This invention relates to a optical fiber guided projectile system, and, more particularly, to an optical fiber guided projectile capable of being fired from a tubular launcher, such as a mortar or a cannon, and to the control system therefor.

2. Description of Related Art

Means for in-flight guidance of projectiles, such as missiles, are known. Originally, such guidance was primarily provided through means of on-board systems. The complexity and cost of these systems led to radio, radar or laser controlled systems. These systems also required expensive and complex equipment to be carried by the projectile and were subject to interference with the signals to or from the projectile. A more recent development is the wire guided projectile. Such systems eliminated the need for complex on-board equipment and precluded interference with data transfer. These systems, however, were limited in terms of the volume and direction of data transfer to and from the projectile.

The advent of optical fiber as a communication means offers advantages over the wire guided systems since optical fibers can transmit substantially greater volume of data than wire of comparable size, and optical fiber can accommodate data traveling in both directions simultaneously. To obtain simultaneous two-way communication with wire-guided systems two parallel wires are required.

Riley, U.S. Pat. No. 4,185,796, teaches the use of optical fibers as a communication link between a missile and a remote guidance and control system. The system of Riley discloses two-way transmission of data over an optical fiber which streams from a bobbin in the missile during flight. The specific nature of the missile and its launch system is not disclosed in Riley. Additionally, Riley does not teach a control system providing direct operator input to missile guidance in response to real time target data sensed by the missile.

Fiber optic control systems have been used to provide two-way data transmission in the U.S. Army's Fiber Optic Medium Assault Weapon (FOMAW) and Fiber Optic Guided Missile (FOG-M). While such systems are satisfactory in certain applications, neither FOMAW, FOG-M nor the Riley device are capable of being launched or fired from existing weapons systems such as mortars or cannon. While desirable, an optical fiber guided projectile capable of being fired from a mortar or cannon has not been developed because the exceedingly high "G" loads, in excess of 10,000 G's, generated during firing destroy the relatively fragile optical fiber. Laten et al, U.S. Pat. No. 4,573,647, is directed to a mechanism for deploying optical fiber while relieving the G forces imposed on the fiber during missile launch. That mechanism involves securing the optical fiber on the outside surface of the missile with tape having a tear strip one end of which is secured to the launch vehicle to tear an opening in the tape as the missile leaves the launch vehicle. The Laten et al device, however, has several disadvantages rendering it unable to be used with a mortar or cannon fired projectile. First, by securing the fiber to the outside surface of the missile, the launch tube must have a diameter greater than the missile; the resulting annular space around the missile would permit blow-by in a mortar or cannon reducing the launch thrust. The use of the tear strip would require modification of the mortar tube or cannon barrel in order to attach the end of the tear strip. Moreover, even after the tape is split by the tear strip, the relatively fragile optical fiber would have to pulled through the torn tape during launch.

The subject invention provides an optical fiber guided projectile capable of being fired from an unmodified mortar or cannon. The optical fiber deployment mechanism of the invention does not interfere with the projectile launch performance and precludes damage to the optical fiber during launch. The invention also provides a control system in which direct, real time operator control of projectile flight and target selection is available.

Other objects and advantages of the invention will be set forth in part in the description which follows, and in part will be apparent from the description, or may be learned by practice of the invention. The objects and advantages of the invention may be realized and attained by means of the instrumentalitites and combinations particularly pointed out in the appended claims.

SUMMARY OF THE INVENTION

In accordance with the purpose of the invention, as embodied and broadly described herein, the optical fiber guided projectile for firing from a generally tubular launcher comprises a generally tubular casing having leading and trailing ends; an extended length of optical fiber disposed in the casing for continuous streaming from the trailing end during flight of said projectile, a portion of said fiber extending from the trailing end of the casing to a one end of the fiber for operative connection to a controller; groove means extending from the trailing end to proximate the leading end in the outside surface of said casing for removeably receiving part of the extending fiber portion; means for securing the part of the extending fiber portion in the groove means with a force sufficient to resist axial forces generated during firing of the projectile and insufficient to resist imposed radial separation of the fiber from the groove means on exit of the projectile from the launcher; and means in the casing connected to the other end of the fiber for data communication through said fiber.

Preferrably, the projectile includes means in the casing for sensing target data and for transmitting that data via the communications means through the optical fiber. The projectile preferrably also includes means in the casing responsive to data received through the fiber via the communications means for controlling the flight path of the projectile.

The optical fiber is preferrably covered with a reinforcing coating and is secured in the groove means by tape or by a cover pivotally secured to the casing at the trailing end thereof such that the cover pivotally falls away from the projectile during launch to deploy the optical fiber.

The invention further comprises command and control means for receiving and processing data transmitted from the projectile and for transmitting guidance data to the projectile.

Prefereably, the command and control means includes means for manually controlling the flight of the projectile.

The invention resides in the novel parts, constructions, arrangements, combinations and improvements shown and described. The accompanying drawings, which are incorporated in and constitute a part of this specification, illustrate the presently preferred embodiments of the invention and, together with the description, serve to explain the principles of the invention.

DESCRIPTION OF THE PREFERRED EMBODIMENTS

Reference will now be made to the present preferred embodiments of the invention, examples of which are illustrated in the accompanying drawings.

Figure 1:
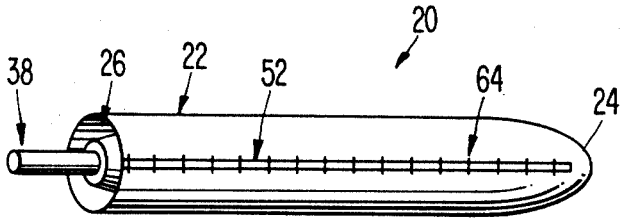
FIG. 1 is a graphic perspective view of the projectile of the invention.
Figure 2:
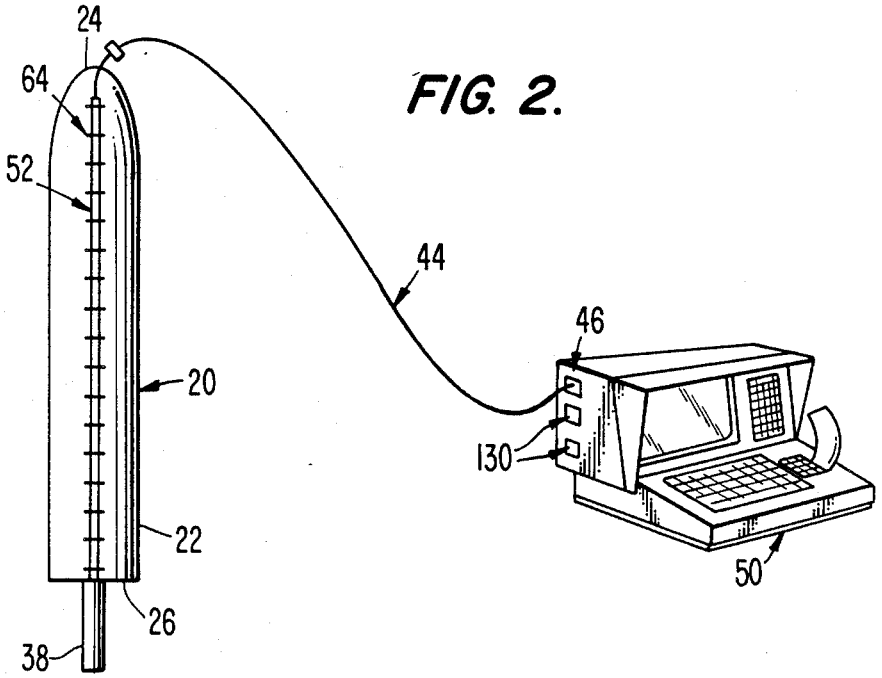
FIG. 2 is a graphic representation of the projectile and command/control console elements of the weapons system of the invention.
Figure 5:
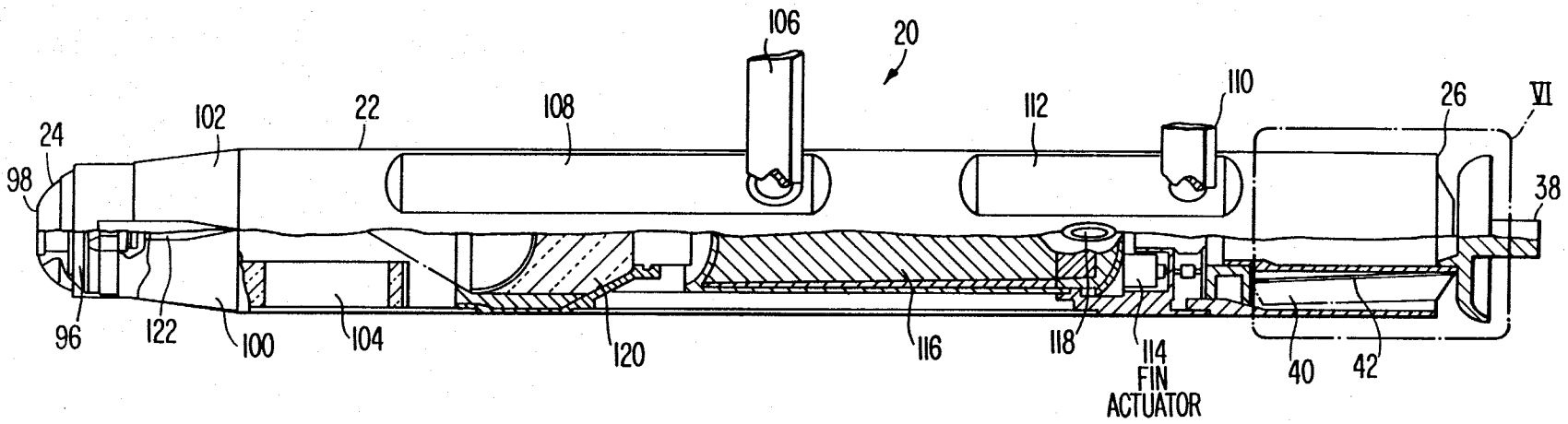
FIG. 5 is a partially cutaway plan view of one embodiment of the projectile of the invention.

In accordance with the invention, the optical fiber guided projectile for firing from a generally tubular launcher comprises a generally tubular casing having leading and trailing ends. As depicted in FIGS. 1, 2 and 5, projectile 20 includes a generally tubular casing 22 having a leading end 24 and a trailing end 26.

Figure 3:
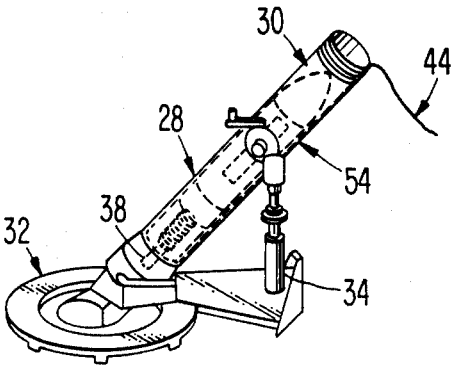
FIG. 3 is a plan view of a conventional mortar partially cut away to show the projectile of the invention in place.

While the projectile of the invention may be fired from a cannon, certain modifications may be necessary if the barrel of the cannon is rifled. The preferred embodiment described herein is designed for firing from a generally conventional mortar. As depicted in FIG. 3, mortar 28 includes a substantially tubular launch tube 30 supported on a base plate 32 and a tripod or mount 34. projectile 20 includes a propellant sting 38 which conventionally cooperates with the mortar to effect firing of the projectile.

In accordance with the invention, the projectile includes an extended length of optical fiber disposed in the casing for continuous streaming from the trailing end during flight of the projectile, a portion of the fiber extending from the trailing end of the casing to a one end of the fiber for operative connection to a controller.

Figure 10:
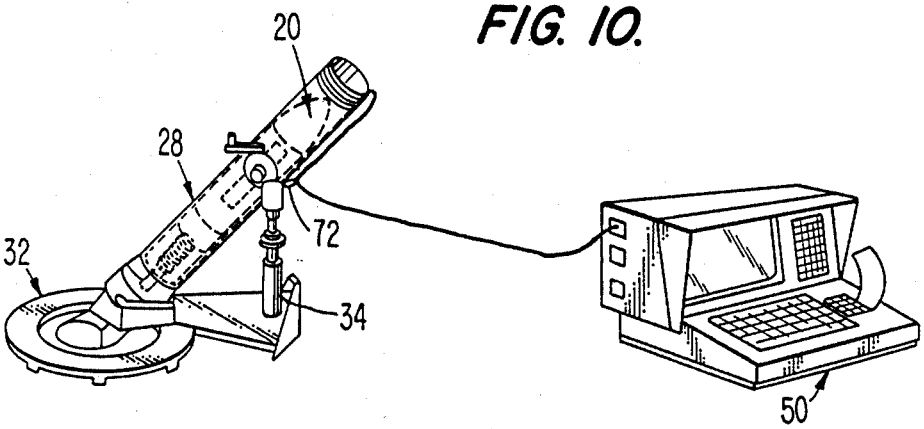
FIG. 10 is a perspective view of one embodiment of the weapons system of the invention.
Figure 11:
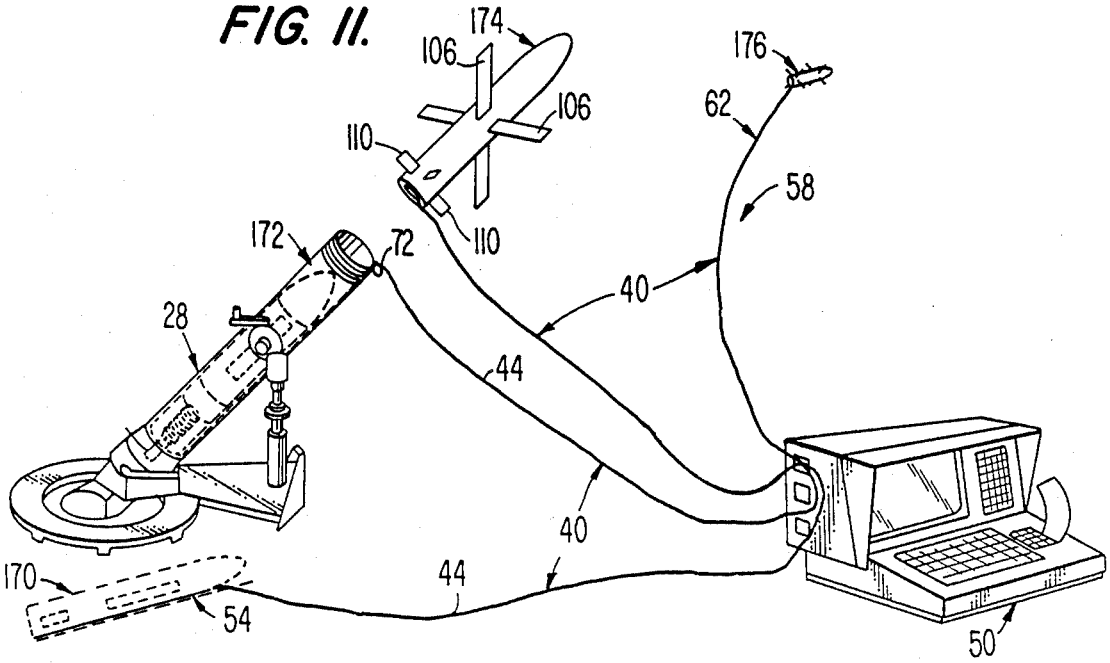
FIG. 11 is a perspective view of the invention depicted in FIG. 10 shown in various modes of operation.

In the preferred embodiment, the extended length of optical fiber 40 is wound on a bobbin 42 disposed in casing 22 proximate trailing end 26, as best seen in FIGS. 5–8. Fiber 40 is wound on bobbin 42 in a manner permitting tangle-free streaming from trailing end 26 while preventing damage to or shifting of the fiber during launch. A method of winding optical fiber on a bobbin which may be used in this invention is disclosed in applicant's copending application, Ser. No. 07/032,243, filed Mar. 31, 1987 which is incoroporated herein by reference. A portion 44 of fiber 40 extends from trailing end 26 of casing 22 to a one end 46 for operative connection to a controller 50 (FIGS. 2, 10 and 11).

The projectile of the invention includes groove means extending from the trailing end to proximate the leading end in the outside surface of the casing for removably receiving part of the extending fiber portion and means for securing the part of the extending fiber portion in the groove means with a force sufficient to resist axial forces generated during firing of the projectile but insufficient to damage the fiber on imposed radial separation of the fiber from the groove means on exit of the proectile from the launcher.

Figure 1A:
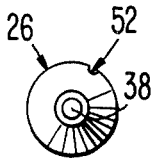
FIG. 1A is a graphic representation of the left end of the projectile of FIG. 1.
Figure 6:
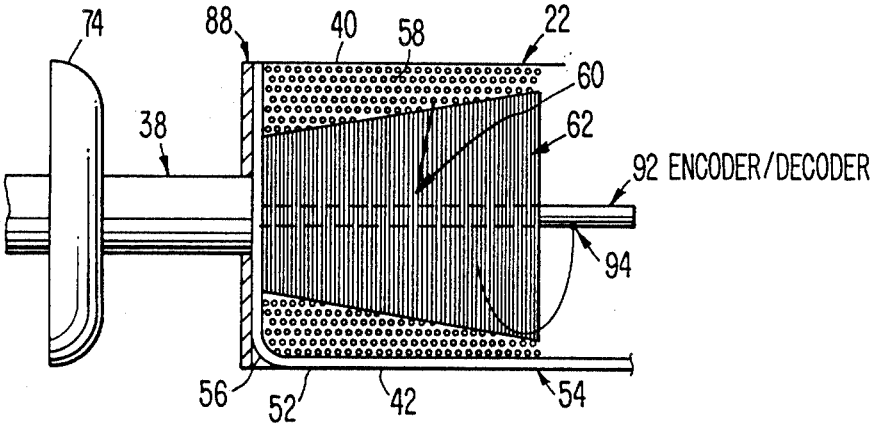
FIG. 6 is an enlarged cross-sectional plan view of the portion of the projectile of FIG. 5 encompassed by line VI.

As depicted in FIGS. 1 and 2, the preferred embodiment of the invention includes groove 52 extending from trailing end 26 to proximate leading end 24 in the outside surface of casing 22 for removeably receiving part 54 of extending fiber portion 44. As depicted in FIGS. 1A and 6, groove 52 accommodates fiber part 54 within the circumference of casing 22 so as not to interfere with the normal annular cooperation between projectile 22 and its tubular launcher, such as mortar barrel 30. Thus, while fiber part 52 axially extends between casing 22 and the inside of the launch tube, the propulsion force is not affected by blow-by.

Groove 52 terminates at trailing end 26 with a contoured bend 56 to avoid sharp bends in the fiber which may cause a fracture detrimental to fiber optical performance.

Preferrably, extending fiber portion 44 is covered with a reinforcing coating which may be plastic or fiberglass-reinforced or metallic-reinforced epoxy. Such a coating protects the fiber portion 44 extending from the launcher to the command/control console 50 and protects part 54 of the portion subjected to the highest stresses during launch. It is also preferred that the reinforcing coating continue on the fiber for a predetermined length so that reinforced fiber 58 (FIG. 6) form the outside layers of fiber 40 on bobbin 42. The reinforcing coating gradually tapers in a transistion 60 to regular, unreinforced fiber 62 forming the inside layers on bobbin 42. A method of manufacturing reinforced optical fiber is disclosed in applicants' copending application, Ser. No. 07/032,242, Mar. 31. 1987, which is incorported herein by reference. Placement of several layers of reinforced fiber on the outside of bobbin 42 serves to prevent damage to or shifting of the more fragile regular fiber 62 during launch. If the fiber shifts or slumps during launch, tangles or other hindrances to free streaming of the fiber from bobbin 42 may result.

Part 54 of fiber extension 44 is preferrably secured in groove 52 by means of one or more pieces of tape 64 adhesively secured to the surface of casing 22 transverse groove 52. Other means for securing part 54 in groove 52 may be used such as a single elongated piece of tape disposed lengthwise along groove 52, or a non-hardening adhesive. The type, number and strength of elements used to secure part 54 in groove 52 may be varied and must be chosen with consideration given to the strength of the reinforced fiber and the G loads imposed on launch. The size of groove 52 should provide a relatively tight fit for part 54 of the fiber to prevent blow-by during firing, but the fit cannot be tight enough to preclude the need for some means for holding the fiber in the groove during handling and loading and during launch since the force necessary to remove part 54 from groove 52 during launch should be minimal. Accordingly, tape 64 or other means of securing the fiber part 54 must be chosen to have sufficient strength to resist forces generated during launch but insufficient to resist radial force imposed on the fiber as the projectile leaves the launch tube. The radial force necessary to remove part 54 from groove 52 must be less than the fracture strength of the reinforced fiber and must minimize the force imposed on the projectile to avoid affecting the desired trajectory of the projectile.

Figure 4:
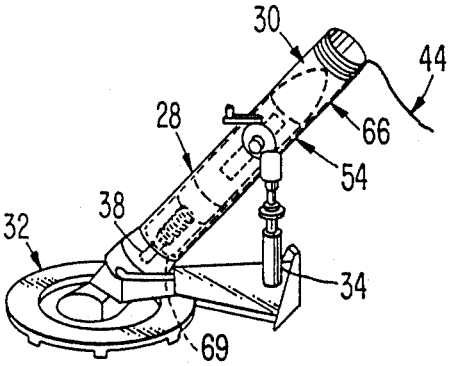
FIG. 4 is a plan view of a conventional mortar partially cut away to show an alternative embodiment of the projectile of the invention in place.
Figure 4A:
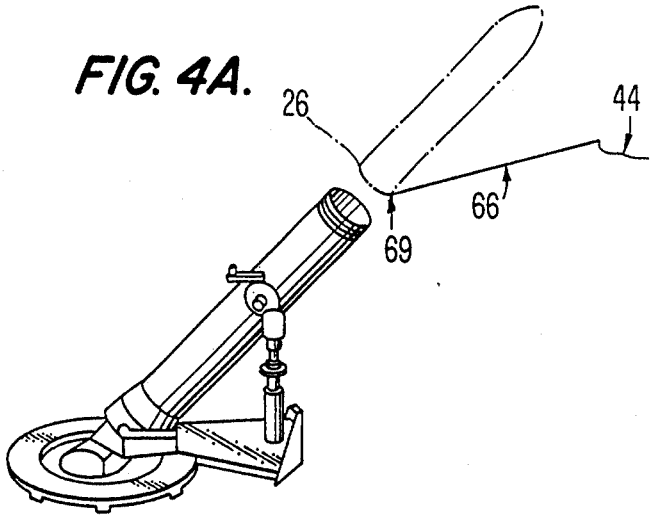
FIG. 4A depicts the relation of the projectile and mortar of FIG. 4 after firing.

An alternative means of securing fiber part 54 in groove 52 is depicted in FIGS. 4 and 4A. In this embodiment, the securing means comprises an elongated, substantially rigid cover 66 disposed in groove 52 defining an enclosed channel for receiving part 54 of extending fiber portion 44. Cover 66 may be in the form of a longitudinal half tube. Cover 66 is preferrably pivotally attached by a hinge structure 69 at trailing end 26 and is loosely secured in groove 52 such that tension forces about hinge 69 generated at launch are sufficient to remove cover 66 from groove 52.

Figure 3A:
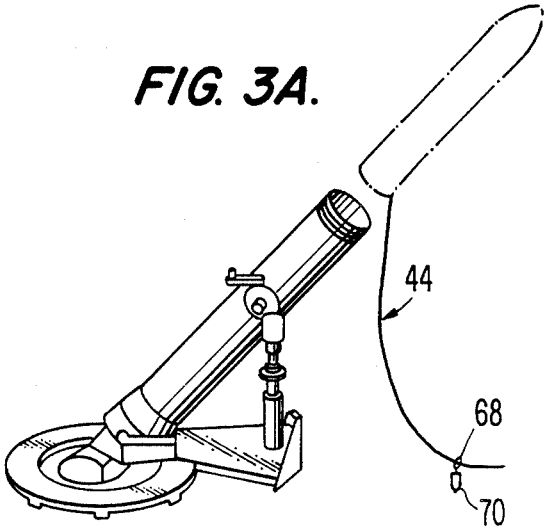
FIG. 3A depicts the relation of the projectile and mortar of FIG. 3 after firing.

Imposing a radial force on the fiber part 54 to remove the fiber from groove 52 as the projectile leaves the launch tube is preferrably accomplished by a one-way snubber engaging extending fiber portion 44 between the launch tube and the controller. Since it is preferrable to avoid any modifications to the launch device, snubber 68 (FIG. 3A) may be secured to some object or surface 70, such as the ground, proximate the launch tube. Snubber 68 imposes a radial force on fiber part 54 as the projectile leaves the launch tube while preventing application of force at one end 46 of fiber 44 connected to controller 50. An alternative disposition of a snubber is attachment by means of a removable pigtail 72 to the launch tube or support structure 34 proximate the muzzle thereof (FIG. 10).

Figure 7:
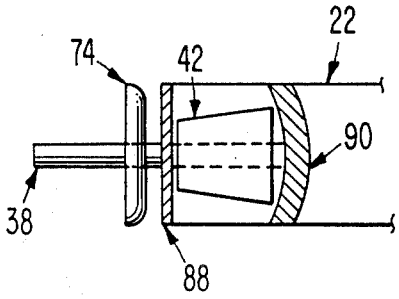
FIG. 7 is a representation of the optical fiber bobbin structure in the projectile of the invention.
Figure 8:
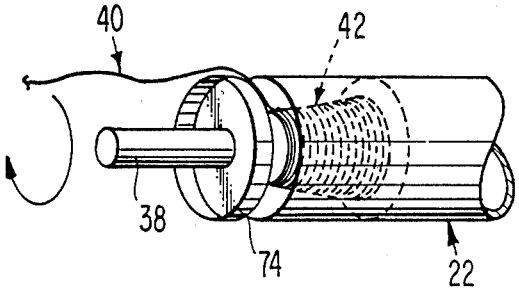
FIG. 8 is a perspective view of the bobbin structure of FIG. 7 shown in operation.

The shape of bobbin 42 and the diposition of fiber 40 thereon results in fiber 40 forming a helix pattern as it streams from trailing end 26. Sting 38 should not interfere with removal of fiber 40 from the projectile during flight, but to insure that it does not means for guiding the fiber as it streams from casing 22 during flight, preferrably, is included in the projectile. As depicted in FIGS. 6–8, sting 38 includes circular adaptor 74 coaxially secured to sting 38 and axially spaced from trailing end 26 of casing 22. Adaptor 74 has a rounded periphery for guiding fiber 40 as it streams in a helix pattern from the proectile. The diameter of adaptor 74 and its axial distance from trailing end 26 are chosen to assist rather than change the natural helix pattern of fiber 40 as it streams from the projectile as depicted in FIG. 8. The shape, diameter and materials of adaptor 74 must be chosen to avoid interference with the aerodynamics of the projectile and may be selected to provide a gas seal to prevent expanding gases from escaping past the projectile, called blow-by. Thus, adaptor 74 may function as an obdurator as well as a fiber guide.

Figure 9:
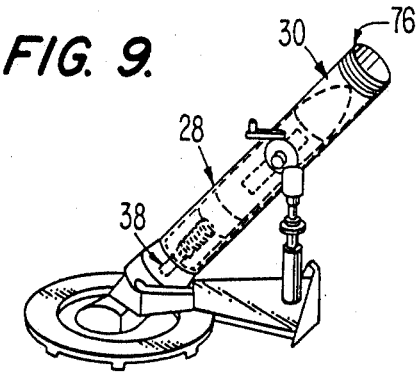
FIG. 9 is a plan view of a conventional mortar cut away to show an alternate embodiment of the projectile of the invention in place.
Figure 9A:
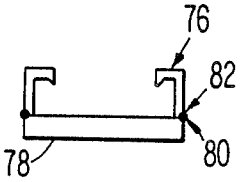
FIG. 9A is a cross-sectional view of the grabber as depicted on the muzzle of the mortar of FIG. 9.
Figure 9B:
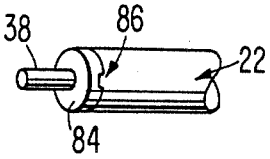
FIG. 9B is an enlarged perspective view of the trailing end of the projectile shown in place in FIG. 9.

An alternative embodiment which eliminates possible interference between sting 38 and streaming fiber 40 is depicted in FIGS. 9, 9A and 9B. In this embodiment, sting 38 is designed to drop away from the projectile during launch by action of the reinforced fiber or by action of a grabber element 76 disposed in the muzzle of the launch tube 30. Two or more grabber elements 76 are pivotally secured to muzzle exit lip 78 by hinge 80 which is biased by spring 82 toward the axis of tube 30. Sting 38 is fixed to plate 84 removeably fixed to trailing end 26 of casing 22. Plate 84 includes notches 86 disposed for engagement by grabbers 76 as the projectile leaves tube 30. The direction of removal of sting 38 and its associated plate 84 is contolled by the shape and placement of grabber elements 76.

As depicted in FIGS. 6 and 7, the projectile preferrably includes a frangible end plate 88 enclosing trailing end 26 to protect bobbin 42 and fiber 40 during shipment and handling. End plate 88 is designed to break during launch either from the force of the launch or the action of the reinforced fiber as it is removed from casing 22. Bobbin 42 and fiber 40 may also be further protected by disposing bobbin 42 axially adjacent a structural hard point 90 of casing 22.

In accordance with the invention, the projectile includes means in the casing connected to the other end of the fiber for data communication through the fiber. Preferrably, the projectile also includes means in the casing for sensing target data and for communicating that data via the communications means through the fiber. The projectile also preferrably includes means in the casing responsive to data received through the fiber via the communication means for controlling the flight path of the projectile.

In the preferred embodiment as depicted in FIGS. 5 and 6, the communication means is an electro/optical encoder/decoder 92 disposed in casing 22 and connected to the other end 94 of fiber 40. The encoder/decoder 92 constitutes two elements, a decoder operating at a frequency F1 for receiving data in optical form through fiber 40 and transforming the data to corresponding electrical signals and an encoder operating at a frequency F2 for receiving electrical signals generated by components in the casing and transforming those signals to optical form for transmission through fiber 40. The use of optical fiber 40 permits simultaneous two-way transmission to and from the encoder/decoder.

The projectile preferrably includes a target seeker, sensor or camera 96 disposed in casing 22 proximate leading end 24 behind a protective dome 98. Such seekers, sensors or cameras and associated controls are well known in the art. One example of a seeker is disclosed in applicant's U.S. Pat. No. 4,615,496. Equally well known and disposed in casing 22 is electronic means for converting data received by a seeker to electrical signals. Such signals are conveyed to encoder 92 for transmission over fiber 40. Known rate sensors and accelerometers 102, for stabilization and control, are also disposed in casing 22 and electrically connected to encoder/decoder 92 for communicating over fiber 40 projectile trajectory data. All electrical equipment is powered by battery 104, such as a thermal battery, disposed in casing 22.

The projectile also includes means responsive to data received over fiber 40 for guidance. As depicted in FIG. 5, two sets of air foils are provided. Wings 106 are stored in wing storage area 108 and extended after launch to provide lift for increased flight range and performance. Fins 110 are stored in fin storage area 112 and extended after launch. A fin actuator 114 is disposed in casing 22 in electrical communication with decoder 92 for selectively altering the flight trajectory of the projectile in response to signals received over fiber 40. Preferrably, fin actuator 114 comprises an actuator driver disposed to receive guidance data from decoder 92 and to transmit pulse width modulation commands to fin controllers for selectively positioning fins 110. Alternatively, fins may be positioned by gas actuators functioning in response to data received over fiber 40 through decoder 92. The projectile also includes a sustainer motor 116 and sustainer nozzles 118.

In the embodiment depicted in FIG. 5, the projectile includes a warhead 120 and a standoff fuse 122. Other embodiments of the invention may be used for purposes, such as establishing communication between remote locations, which do not require the warhead and fuse.

The two-way data transmission afforded by the optical fiber permits retaining on the ground most of the electronics necessary or desirable for guiding a projectile, thus substantially reducing the weight, complexity and cost of the projectile. p The invention also includes a system essentially comprising the projectile as described above and a command and control means for receiving and processing target data transmitted from the projectile and for transmitting guidance data to the projectile. The command and control means is embodied in control console 50 operatively connected to one end 46 of extended fiber portion 44. Console 50 preferrably includes a plurality of optical fiber interface connectors 130 (FIG. 2) providing means for connecting several projectiles to a single controller 50. The multiple connectors 130 permit rapid set-up and sequential firing of projectiles which is frequently a battlefield requirement.

Figure 12:
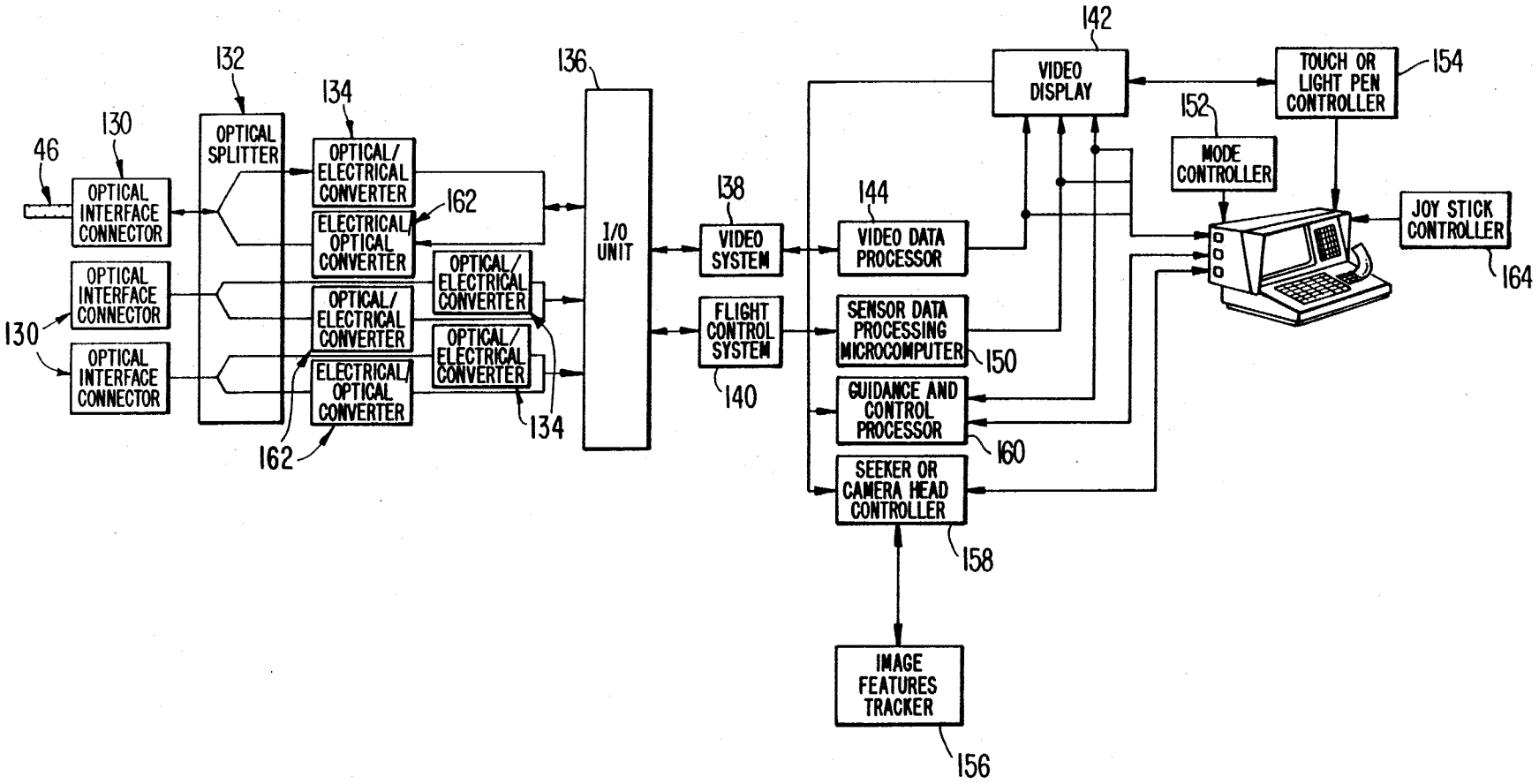
FIG. 12 is a diagrammatic representation of the circuitry of the command and control means of the weapons system of FIG. 10.

The command and control means includes in controller 50 means for presentation of real-time target data received from the projectile in various forms and means for controlling projectile flight by transmission of control data to the projectile, including direct operator interface. As depicted in FIG. 12, the command and control means preferrably includes an optical splitter 132 in communication with each optical interface connector 130. Splitter 132 separates incoming signals from outgoing signals both of which are traveling over the optical fiber. The incoming signal, encoded by encoder 92 in the projectile, is converted into an electrical signal by optical/electrical converter 134. Converter 134 may be a pin-type detector responsive to signals at a selected wavelength. Encoder 92 in the projectile transmits at frequency F2 and converter 134 is set to receive at that frequency. Converter 134 generates an electrical signal analog of the input optical signal, amplifies the signal to the desired level, and formats the incoming data. Signals from converter 134 are conveyed to an I/O unit 136 from which the data is routed to either a video system 138 or a flight control system 140 depending on the format and the identifier placed on the data by the I/O unit 136.

Data transmitted to the video system goes directly to the video display 142 and/or to a video data processor 144. Data processor 144 permits raw data to be displayed at video display 142, permits false color data representations to be presented, permits data from multiple sensors to be overlayed on the display, permits electronic zoom or magnification of a part of the display, and permits manipulations of contrast and other processing of data using various data analysis and correlation techniques.

Data input to the video system 138 may be taken from visible light, infrared or ultraviolet focal plane array camera, scanning camera, or conventional vidicon, or millimeter wave sensor, and the data may be from any single or multiple sensors. For example, dual mode infrared/millimeter wave seekers provide infrared and millimeter wave signals from which images can be created where the position of the seeker head and its motion is known. Such images are displayed by the video data processor 144 on display 142 for use by the operator.

The command and control also preferrably includes a sensor data processing computer 150 which functions to execute target recognition and identification algorithms individually for infrared and millimeter wave signals, to determine parameters, such as range to target, for use in guidance and control algorithms, and to execute target recognition and identifier algorithms based on both infrared and millimeter wave data.

Output of sensor data processing computer 150 is routed to video display 142 by mode controller 152. Thus, if the operator detects a target and wishes to initiate an attack, he can designate display of the selected target on display 142. The operator/data interface may be by use of a touch or light pen actuator 154 which permits rapid control action. Activation of the light pen actuator 154 initiates a sequence of events by mode controller 152 which transmits target identification, for example, to the image feature tracker 156 which is in two-way communication with seeker head controller 158. The latter generates signals to control the seeker in the projectile and through guidance and control processor 160 initiates and executes projectile traectory changes to effect an attack on the selected target.

Information from guidance and control processor 160, seeker or camera head controller 158, and mode controller 152 are transmitted through flight control system 140 where it is tagged and formatted and routed to I/O unit 136 for transmission at frequency F1 via electrical/optical converter 162 to the projectile.

Controller 50 includes a joy stick contoller 164 permitting direct operator control of projectile flight for purposes of examining additional targets or manually flying the projectile onto the target. All normal and routine flight control and navigation functions are automatically performed by guidance and control processor 160.

In operation, a plurality of projectiles will be available at a launch site in association with a mortar launcher and a controller. Thus, as depicted in FIG. 11, projectiles 170, 172, 174 and 176 are all connected by optical fiber 40 to controller 50. Projectile 170 is in reserve and is depicted with part 54 of fiber extending portion 44 diposed in the groove in casing 22. Projectile 172 has been dropped into mortar tube 28 after reinforced fiber portion 44 is attached to a snubber on pigtail 72 and to console 50. The projectile propulsive charge is then ignited in the usual manner propelling the projectile from tube 28. Snubber 72 pulls fiber part 54 from the groove and the frangible end plate is removed as the projectile leaves the tube. The reinforced fiber then streams from the bobbin. After some length of flight, the fiber transitions from reinforced fiber 58 to regular fiber 62. Controller 50 is used by the operator to select a target for and control attack of projectile 176, and then the controller shifts to performing the same function for the other projectiles.

The invention provides a optical fiber guided projectile capable of being fired from a tubular launcher and a control system for guiding the projectile while in flight. It will be apparent to those skilled in the art that various modifications and variations could be made to the projectile and control system of the invention without departing from the scope or spirit of the invention.

What is claimed is:

1. An optical fiber guided projectile for firing from a generally tubular launcher, said projectile comprising:

a generally tubular casing having leading and trailing ends;

an extended length of optical fiber disposed in said casing for continuous streaming from the trailing end during flight of said projectile, a portion of said fiber extending from the trailing end of said casing to a one end of said fiber for operative connection to a controller;

groove means extending from the trailing end to proximate the leading end in the outside surface of said casing for removeably receiving part of said extending fiber portion;

means for securing the part of said extending fiber portion in said groove means with a force sufficient to resist axial forces generated during firing of said projectile and insufficient to resist imposed radial separation of said fiber from said groove means on exit of said projectile from said launcher; and means in said casing connected to the other end of said fiber for data communication through said fiber.

2. The projectile of claim 1 also including means in said casing for sensing target data and transmitting that data via said communication means through said fiber.

3. The projectile of claim 1 also including means in said casing responsive to data received through said fiber via said communication means for controlling the flight path of said projectile.

4. The projectile of claim 1 wherein said extending fiber portion is covered in a reinforcing coating.

5. The projectile of claim 4 wherein said coating is selected from plastic, fiberglass-reinforced epoxy or metallic-reinforced epoxy.

6. The projectile of claim 1 also including means axially spaced from the trailing end of said casing for guiding the fiber streaming from said casing during flight of said projectile.

7. The projectile of claim 6 wherein said guiding means includes means for preventing expanding gas blow-by.

8. The projectile of claim 1 wherein said securing means comprises an elongated, substantially rigid cover in said groove means defining an enclosed channel for receiving the part of said extending fiber portion, said cover being pivotally attached to said casing at the trailing end thereof and being loosely secured in said groove means for pivotal removal therefrom on firing said projectile from said launcher.

9. The projectile of claim 1 wherein said securing means comprises one or more pieces of tape adhesively secured to the surface of said casing transverse said groove means.

10. The projectile of claim 1 wherein said securing means is adhesive removably securing said fiber in said groove means.

11. The projectile of claim 1 wherein said extended length of optical fiber is wound on a bobbin disposed in said casing proximate the trailing end thereof.

12. The projectile of claim 10 wherein the outside layers of said fiber wound on said bobbin are reinforced.

13. The projectile of claim 11 also including a frangible end plate enclosing said trailing end to protect said bobbin.

14. The projectile of claim 1 wherein said communications means comprises an electro/optical encoder/decoder providing two-way communications between said projectile and a controller.

15. An optical fiber guided weapons system for firing a projectile from a generally tubular launcher and guiding said projectile to a target, said system comprising:

command and control means for receiving and processing target data transmitted from said projectile and for transmitting guidance data to said projectile;

a generally tubular projectile casing having leading and trailing ends;

an extended length of optical fiber disposed in said casing for continuous streaming from the trailing end during flight of said projectile, a portion of said fiber extending from the trailing end of said casing to a one end of said fiber for operative connection to said command and control means;

groove means extending from the trailing end to proximate the leading end in the outside surface of said casing for removeably receiving part of said extending fiber portion;

means for securing the part of said extending fiber portion in said groove means with a force sufficient to resist axial forces generated during firing of said projectile and insufficient to resist imposed radial separation of said fiber from said groove means on exit of said projectile from said launcher;

means engaging said extending fiber portion between said projectile and said command and control means for removing the part of said extending fiber portion from said groove means on exit of said projectile from said launcher;

means in said casing for sensing tarqet data;

means in said casing for selectively guiding the flight path of said projectile; and means in said casing connected to the other end of said fiber for providing two-way data communication through said fiber between said sensing and guiding means and said command and control means.

16. The system of claim 15 wherein said command and control means comprises means for displaying data received through said fiber from said projectile, microprocessor means for target recognition and identification and for generating projectile guidance and control signals, and means for transmitting guidance and control signals to said projectile.

17. The system of claim 16 wherein said command and control means further comprises means for manually controlling the flight of said projectile.

18. The system of claim 16 wherein said command and control means includes means for receiving data from and controlling more than one projectile.

* * * * *

UNITED STATES PATENT AND TRADEMARK OFFICE

CERTIFICATE OF CORRECTION

PATENT NO. : 4,770,370

DATED : September 13, 1988

INVENTOR(S) : George T. Pinson

It is certified that error appears in the above-identified patent and that said Letters Patent is hereby corrected as shown below:

Column 2, line 48, "preferrably" should be --preferably--;
Column 2, line 51, "preferrably" should be --preferably--;
Column 2, line 55, "preferrably" should be --preferably--;
Column 2, line 65, "Preferrably" should be --Preferably--;
Column 4, line 50, "Preferrably" should be --Preferably--;
Column 5, line 3, "preferrably" should be --preferably--;
Column 5, line 36, "Preferrably" should be --Preferably--;
Column 5, line 43, "preferrably" should be --preferably--;
Column 6, line 24, "preferrably" should be --preferably--;
Column 6, line 56, "preferrably" should be --preferably--;
Column 7, line 31, "The Invention" should start a new paragraph.
Column 7, line 51, "preferrably" should be --preferably--;
Column 8, line 22, "preferrably" should be --preferably--;

Signed and Sealed this

Fourth Day of July, 1989

*Attest:*

DONALD J. QUIGG

*Attesting Officer*

*Commissioner of Patents and Trademarks*